United States Patent [19]

Harris

[11] 4,428,086

[45] Jan. 31, 1984

[54] BED SUPPORT SIDE RAIL MEMBER

[76] Inventor: George M. Harris, 505 N. Lake Shore Dr., Chicago, Ill. 60611

[21] Appl. No.: 317,170

[22] Filed: Nov. 2, 1981

[51] Int. Cl.[3] ..... A47C 19/00

[52] U.S. Cl. ..... 5/200 C; 5/200 R; 5/282 R; 5/286

[58] Field of Search ..... 5/200 R, 200 C, 201, 5/282 R, 285, 286, 111, 114, 117; 403/339, 340

[56] References Cited

U.S. PATENT DOCUMENTS

| | | | |
|---|---|---|---|
| 603,814 | 5/1898 | Dipman et al. | 5/200 C |
| 611,049 | 8/1898 | Allen | 5/200 C |
| 1,765,455 | 6/1930 | Schultz | 5/286 |
| 1,855,307 | 4/1932 | Nigg | 5/200 C |
| 2,383,938 | 8/1945 | Mackenzie | 403/339 |
| 4,263,683 | 4/1981 | Knoke | 5/286 |

*Primary Examiner*—Alexander Grosz
*Assistant Examiner*—Michael F. Trettel
*Attorney, Agent, or Firm*—Dressler, Goldsmith, Shore, Sutker & Milnamow, Ltd.

[57] ABSTRACT

A knock-down side rail member for support of a box spring and mattress set. The side rail member includes a pair of side rail sections which are secured together by a connecting bracket. The horizontal surfaces of the side rail sections and the connecting bracket are coplanar. The connecting bracket is permanently secured to one of the side rail sections.

6 Claims, 5 Drawing Figures

BED SUPPORT SIDE RAIL MEMBER

BACKGROUND OF THE INVENTION

This invention relates to bed support side rails and, more particularly, to an improved knock-down side rail member.

It is well known to support a box spring and mattress set above a floor by use of support frames which include a pair of spaced apart parallel side rail members which extend between a headboard and an endboard. The side rail members typically take the form of a unitary longitudinally extending angle iron member, of L-shaped cross section, having end plates associated with the respective ends. The end plates are secured to the respective headboard or endboard above the floor. The box spring and mattress set is supported on the horizontal surfaces of the side rail members. The side rail members are approximately six feet in length to support standard size box spring and mattress sets.

A problem has long existed in the art in the handling, transporting, warehousing, and packaging of such side rail members due to their excessive length. It has heretofore been proposed to form such side rail members from two angle iron side rail sections which are secured together in an end to end relation by use of a short angle iron connecting bracket. The bracket is secured to the two side rail sections, in overlapping relation thereto, by use of at least one releasable fastener passing through the vertical and horizontal leg portions of each side rail section and the corresponding vertical and horizontal leg portions of the bracket. Accordingly, it is necessary for the assembler to manually align at least four corresponding sets of openings and assemble fasteners therethrough. The horizontal leg portion of the heretofore proposed side rail members do not define a coplanar surface for the support of the box spring and mattress set. The connecting bracket and the fasteners extend upwardly of the plane passing through the horizontal leg portions. This causes bending stresses to be applied to the box spring frame structure supported thereon, which tends to reduce the useful life of the box spring.

SUMMARY OF THE INVENTION

The foregoing disadvantages of the heretofore proposed side rail member designs are overcome in accordance with the present invention which provides a knock-down side rail member having a pair of generally L-shaped side rail sections that are adapted to be secured together in an end to end relationship. The horizontal and vertical leg portions of the side rail sections have outwardly offset portions at their adjacent ends. A generally L-shaped connecting bracket is received within the offset portions and secured to the side rail sections. This results in a side rail member having substantially coplanar horizontal and vertical surfaces. Accordingly, no bending stresses are applied to the box spring which rests upon the horizontal leg portions. A further feature of the present invention is the riveting of the connecting bracket to one of the side rail section ends. This facilitates the assembly of the side rail member by reducing the number of fasteners which must be aligned and secured by the assembler.

DETAILED DESCRIPTION

Figures 1, 2, 3, 4, 5:
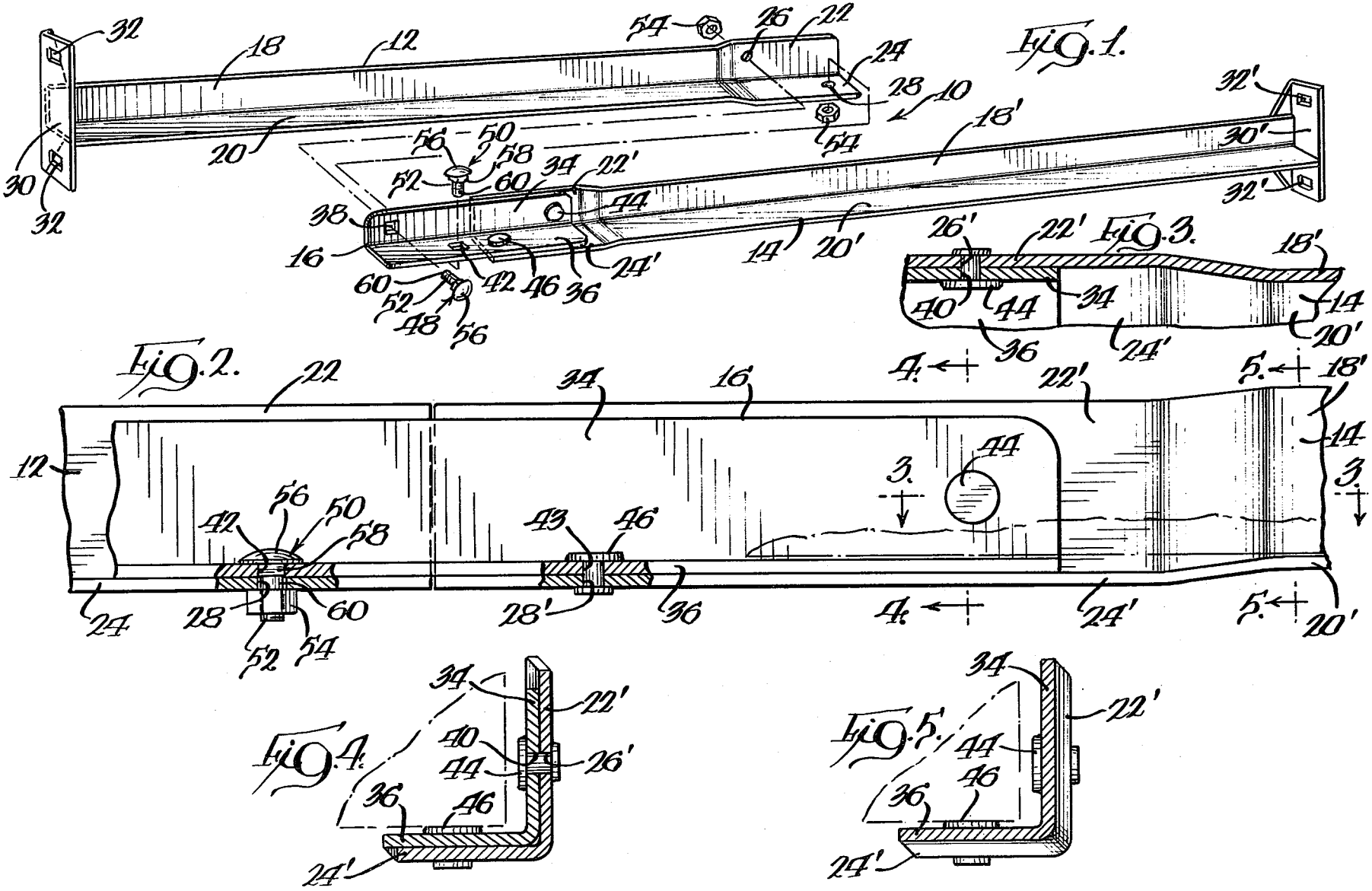
FIG. 1 is an exploded view of a preferred embodiment of the improved side rail member of the present invention.
FIG. 2 is an enlarged, fragmentary side elevational view of the interconnected side rail sections of the improved member in its assembled position with certain portions of the structure being shown in cross section.
FIG. 3 is a sectional view taken along line 3—3 in FIG. 2.
FIG. 4 is a sectional view taken along line 4—4 in FIG. 2.
FIG. 5 is a sectional view taken along line 5—5 in FIG. 2.

Referring now to the drawings, and in particular to FIG. 1, the side rail member of the present invention is indicated generally at 10. Side rail member 10 includes a pair of side rail sections 12 and 14 and a connecting bracket 16. Side rail sections 12 and 14 are the mirror image of each other and, accordingly, only the structural details of side rail section 12 will be discussed. The same numerals are used to designate corresponding structural details of side rail sections 12 and 14, with the corresponding structural detail of section 14 being followed by a prime sign.

Section 12 is formed from an elongated angle iron member, of L-shaped cross section, having a vertical leg portion 18 and a horizontal leg portion 20. A portion adjacent to the ends of leg portions 18 and 20 is outwardly offset as indicated respectively at 22 and 24. A circular opening 26 is provided at the inner end of offset portion 22 and a circular opening 28 is provided adjacent to the outer end of offset portion 24. An end plate 30 is secured to the other end of side rail section 12. End plate 30 has openings 32, for receipt of fastening means therethrough, to secure the side rail section to either a headboard or an endboard.

Connecting bracket 16 is formed from a relatively short angle iron member, of L-shaped cross section, having a vertical leg portion 34 and a horizontal leg portion 36. Leg portions 34 and 36 are of substantially the same width and thickness as corresponding leg portions 18 and 20. Connecting bracket 16 has a square opening 38 adjacent to one end of vertical leg portion 34 and a circular opening 40 adjacent to the other end of vertical leg portion 34. A square opening 42 is provided through a central portion of horizontal leg portion 36. A circular opening 43 is provided through horizontal leg portion 36 adjacent to square opening 42, on the same side of connecting bracket 16 as opening 40. The space relationship of the various openings will become more apparent in the discussion of the assembly of the side rail member 10.

In accordance with the present invention, connecting bracket 16 is rigidly secured to side rail section 14 by use of rivet members 44 and 46. Connecting bracket 16 is positioned within offset portions 22' and 24' such that openings 26' and 40 are in horizontal alignment and openings 28' and 43 are in vertical alignment. Rivet member 44 extends through openings 26' and 40 and rivet member 46 extends through openings 28' and 43. It should be appreciated that side rail section 14 and connecting bracket 16 are permanently secured together and require no additional assembly steps at the time of on-site assembly of the side rail member 10. Additionally, it is not necessary to separately package loose fasteners for the on-site assembler to secure section 14 to bracket 16.

Assembly of the side rail section 12 to the already assembled connecting bracket 16 and side rail section 14 is typically carried out at the site of use of the side rail member 10. This assembly is initiated by bringing together the like corresponding leg portions of the side rail sections 12 and 14 into an end to end abutting relationship, with bracket 16 in facing relationship to offset portions 22 and 24, as seen in FIG. 2. In this relationship, openings 26 and 38 are in horizontal alignment and openings 28 and 42 are in vertical alignment. Releasable fasteners 48 and 50, of identical design, respectively extend through the aligned openings, as depicted in phantom lines in FIG. 1. Fasteners 48 and 50 are preferrably of the type which includes a threaded bolt 52 and a locking nut 54. Bolt 52 has a rounded head portion 56 and a shank portion having a portion 58, adjacent to head 56, of square cross section, and a portion 60 which is threaded to receive nut 54. Portion 58 is dimensioned to be received into the respective openings 38 and 42 so as to prevent rotation of the fastener when nut 54 is tightened to rigidly secure the sections 12 and 14 together.

Side rail member 10, in accordance with the above described construction, defines a substantially coplanar horizontal surface which includes leg portions 20, 36 and 20' for the box spring to rest upon, as indicated by a phantom line in FIG. 2. This is attained by dimensioning the depth of offset portions 24 and 24' to approximately the thickness of leg portion 36. This permits the box spring to be supported on the horizontal surface of the side rail 10 without resultant bending stresses being applied to the frame structure of the box spring. It should also be noted, that, by similarly dimensioning offset portions 22 and 22' a substantially coplanar vertical surface is defined which reduces the likelihood of the box spring cover being torn by the connecting bracket 16. The corners of bracket 16 may be rounded to further protect the box spring cover.

The side rail member 10, in accordance with the present invention, is simple in construction and easily and rapidly assembled. Further, the assembled member 10, does not result in the application of bending stresses to the frame of the box spring or have sharp surfaces which would tend to tear the box spring cover.

What is claimed is:

1. A side rail member for supporting bed means in spaced relationship to a floor, comprising a pair of elongated side rail sections of generally L-shaped cross section positioned in end to end relationship, said rail sections having vertical leg portions and horizontal leg portions, said vertical leg portions and horizontal leg portions of each of said side rail sections having outwardly offset portions at their adjacent ends, a generally L-shaped connecting bracket having a vertical leg portion and a horizontal leg portion received within said offset portions of said side rail sections, said outward offset portions having a depth which is substantially equal to the thickness of the vertical and horizontal leg portions of said connecting bracket, and fastening means for securing said connecting bracket to said pair of side rail sections.

2. The invention as defined in claim 1 wherein said fastening means includes rivet means passing through the offset portions of the vertical and horizontal leg portions of one of said pair of rail sections and said connecting bracket and releasable fastener means passing through the offset portions of the vertical and horizontal leg portions of the other of said pair of side rail sections and said connecting bracket.

3. The invention as defined in claim 2 wherein said rivet means includes a first rivet member passing through an outer end of the vertical leg portion of said connecting bracket and the inner end of the corresponding offset portion of the vertical leg portion of said side rail section, and a second rivet member passing through a central portion of the horizontal leg portion of said connecting bracket and the outer end of the corresponding offset portion of the horizontal leg portion of said side rail section.

4. The invention as defined in claim 3 wherein said releasable fastener means includes a first fastener member passing through the other outer end of the vertical leg portion of said connecting bracket and the inner end of the corresponding offset portion of the vertical leg portion of said other side rail section, and a second fastener member passing through a central portion of the horizontal leg portion of said connecting bracket and the outer end of the corresponding offset portion of the horizontal leg portion of said other side rail member.

5. The invention as defined in claim 4 wherein said connecting bracket has square shaped openings for receipt of said first and second fastener members therethrough and said first and second fastener members have square shaped shank portions for receipt within said openings.

6. The invention as defined in claim 1 wherein the outer ends of said side rail sections have end plate means rigidly secured thereto for attachment of the respective ends of said rail sections to a headboard and an endboard.

* * * * *

UNITED STATES PATENT AND TRADEMARK OFFICE

CERTIFICATE OF CORRECTION

PATENT NO. : 4,428,086

DATED : January 31, 1984

INVENTOR(S) : George M. Harris

It is certified that error appears in the above-identified patent and that said Letters Patent is hereby corrected as shown below:

On the title page add:

[73] Assignee: HARRIS-HUB COMPANY, INC.,
Harvey, Illinois

Signed and Sealed this

*Sixteenth* Day of *April 1985*

[SEAL]

*Attest:*

DONALD J. QUIGG

*Attesting Officer* *Acting Commissioner of Patents and Trademarks*